US005705968A

United States Patent [19]

Beck et al.

[11] Patent Number: 5,705,968

[45] Date of Patent: Jan. 6, 1998

[54] TRIP BAR WITH ADJUSTABLE LATCH LOAD FOR ELECTRICAL SWITCHING APPARATUS

[75] Inventors: H. Richard Beck, Coraopolis; David E. Little, Beaver Falls; Kenneth M. Fischer, Union Township; Richard E. White, Brighton Township, all of Pa.

[73] Assignee: Eaton Corporation, Cleveland, Ohio

[21] Appl. No.: 645,663

[22] Filed: May 14, 1996

[51] Int. Cl.[6] ..... H01H 9/20

[52] U.S. Cl. ..... 335/167; 335/172

[58] Field of Search ..... 335/167–76, 23–25, 335/35

[56] References Cited

U.S. PATENT DOCUMENTS

| | | | |
|---|---|---|---|
| 4,887,057 | 12/1989 | Gula et al. | 335/190 |
| 5,200,724 | 4/1993 | Gula et al. | 335/166 |
| 5,260,533 | 11/1993 | Livesey et al. | 335/172 |
| 5,341,191 | 8/1994 | Crookston et al. | 335/16 |
| 5,471,184 | 11/1995 | Chien et al. | 335/167 |

*Primary Examiner*—Lincoln Donovan
*Attorney, Agent, or Firm*—Martin J. Moran

[57] ABSTRACT

A circuit breaker includes a housing; separable contacts housed by the housing; an operating mechanism, for moving the separable contacts between a closed position and an open position thereof, having a first position and a second position corresponding to the open position; a latching and releasing mechanism for latching the operating mechanism in the first position thereof and for releasing the operating mechanism to the second position thereof; a rotatable trip bar rotatable in a first rotational direction and a second rotational direction for unlatching the latching and releasing mechanism; a sensing mechanism for sensing an electrical condition associated with the separable contacts and for moving the trip bar in the second rotational direction in order to unlatch the latching and releasing mechanism, release the operating mechanism to the second position thereof, and move the separable contacts to the open position thereof; and an adjustable bias spring for biasing the trip bar in the first rotational direction.

20 Claims, 7 Drawing Sheets

TRIP BAR WITH ADJUSTABLE LATCH LOAD FOR ELECTRICAL SWITCHING APPARATUS

BACKGROUND OF THE INVENTION

1. Field of the Invention

This invention is directed to an electrical switching apparatus and, more particularly, to an electrical circuit breaker including a trip mechanism for latching and releasing the circuit breaker operating mechanism.

2. Background Information

Electrical switching devices include, for example, circuit switching devices and circuit interrupters such as circuit breakers, contactors, motor starters and motor controllers. Circuit breakers are generally old and well known in the art. Examples of circuit breakers are disclosed in U.S. Pat. Nos. 4,887,057; 5,200,724; and 5,341,191. Such circuit breakers are used to protect electrical circuitry from damage due to an overcurrent condition, such as an overload condition or a relatively high level short circuit condition.

Molded case circuit breakers include a pair of separable contacts per phase which may be operated either manually by way of a handle disposed on the outside of the case or automatically in response to an overcurrent condition. The circuit breaker includes an operating mechanism which is designed to rapidly open and close the separable contacts, thereby preventing a moveable contact from stopping at any position which is intermediate a fully open or a fully closed position. The circuit breaker also includes a trip mechanism having a sensing mechanism which senses overcurrent conditions in the automatic mode of operation; a trip bar responsive to the sensing mechanism; and a latch mechanism including a trigger mechanism, and a latching and releasing mechanism. During an overcurrent condition, the trip bar responds to the sensing mechanism and releases the trigger mechanism. The trigger mechanism releases the latching and releasing mechanism which, in turn, releases the operating mechanism thereby tripping open the separable contacts.

The circuit breaker further includes a pivoting operating handle, which projects through an opening formed in the breaker housing, for manual operation. The handle may assume two or more positions during normal operation of the circuit breaker. In an on position, the handle is positioned at one end of its permissible travel. When the operating handle is moved to this position, and the breaker is not tripped, the contacts of the circuit breaker close, thereby allowing electrical current to flow from a current source to an associated electrical circuit. Near or at the opposite end of travel of the handle is an off position. When the handle is moved to that position, the contacts of the circuit breaker open, thereby preventing current from flowing through the circuit breaker.

In some circuit breakers, the handle automatically assumes an intermediate position, between the on and off positions, whenever the operating mechanism has tripped the circuit breaker and opened the contacts. Once the circuit breaker has been tripped, the electrical contacts cannot be reclosed until the operating handle is first moved to a reset position and then back to the on position. The reset position, which is at or beyond the off position, is at the opposite end of travel of the handle with respect to the on position. When the handle is moved to the reset position, the trip mechanism is reset in preparation for reclosure of the contacts when the handle is moved back to the on position.

Whenever the circuit breaker handle is in the on position, biasing springs connected to the handle provide a biasing force to a pivot pin. The pivot pin pivotally connects upper and lower links of a toggle mechanism. The lower toggle link is also pivotally connected to an arm carrier carrying the movable contact of one pole of the circuit breaker. The other poles are operated simultaneously by a crossbar. The upper toggle link is pivotally connected to a cradle which can be latched by the latching and releasing mechanism. When the circuit breaker is tripped, and the cradle is unlatched, the cradle rotates under the influence of the biasing springs. With the rotation of the cradle, the biasing springs also cause the collapse of the toggle mechanism. In turn, this causes the separation of the contacts.

After a trip, whenever the handle is rotated toward the reset position, a mechanism engages the cradle, which is in an unlatched position, and rotates the cradle toward a latched position. In turn, the latching and releasing mechanism latches the cradle in its latched position. After this reset operation, the circuit breaker handle may be moved to the on position, thereby closing the contacts.

The trip bar of the trip mechanism is rotatable by one or more trip sources to release the trigger mechanism. "Latch load" is conventionally defined as the force required by a test probe at a trip point on the trip bar, such as the actuation point for accessory attachments, to cause torque about the axial centerline of the trip bar necessary to release the trigger mechanism. At least two other torques are present on the trip bar during a tripping action.

First, there is a frictional torque resisting rotation of the trip bar due to friction between the trip bar and the operating mechanism side plates at trip bar pivot points. The second torque is due to the load imposed by the trigger mechanism on the trip bar at a loading point. This torque tends to push the trip bar "off latch". The force associated with this torque is dependent upon many variables within the circuit breaker operating mechanism (e.g., biasing spring force, parts tolerance) which are normal manufacturing variables. Although attempts are made to manufacture these components as consistently as possible, it is generally extremely costly to tighten tolerances beyond those obtained by normal manufacturing methods. For example, in some prior art circuit breakers having a dual cradle mechanism, precise manufacturing tolerances are necessary between the cradles and the latching and releasing mechanism in order to avoid misoperation and properly latch both cradles.

With suitable moments, a force (e.g., about 300 pounds) in the operating mechanism may be offset by a relatively small load (e.g., about 30 ounces) where a plunger engages the trip bar, thereby controlling a relatively large force with a relatively small force. As a result, even relatively small position variations between the cradles and the latching and releasing mechanism may cause significant changes in the direction of the operating force. This, in turn, reflects directly in the corresponding latch load and "shock-out" sensitivity (i.e., the sensitivity of the operating mechanism to a premature release). The corresponding latch load may be subject to a relatively large amount of variation due to the various positions assumed by components of the operating mechanism and the latching and releasing mechanism resulting from: (1) normal manufacturing tolerances; (2) production heat-treating operations; and (3) normal operating variations between latching operations.

Sufficient latch load is required in order to maintain the circuit breaker operating mechanism in the latched position. Too little load may cause the operating mechanism to shock-out. For example, if the corresponding latch load is too small, the operating mechanism may shock-out to a trip position when the circuit breaker handle is moved to the on position. Also, manual "push-to-trip" operation of the circuit breaker may be adversely affected in the off position of the operation mechanism. In such off position, the force of the operating mechanism is further reduced because the mechanism spring of the operating mechanism is stretched less with respect to the on position. In turn, the corresponding reduced latch load may be insufficient to overcome the normal frictional forces within the operating and trip mechanisms. Conversely, relatively large latch loads may inhibit the automatic mode of operation during an overcurrent condition. Too much load may prevent the operating mechanism from tripping after an overload or short circuit event is detected in the circuit breaker trip unit and a trip initiation is begun. Excessive load may also prevent accessory attachments, such as shunt trips or undervoltage releases, from causing the operating mechanism to trip when appropriate.

In conventional practice, a circuit breaker is assembled and the latch load is measured to ensure that it falls within specified limits. The range of these limits tends to be rather wide in order to increase manufacturing yield. If the latch load is out of specification, the usual remedy is to substitute a new trip bar bias spring and/or manually stretch the bias spring, bend it, or cut one or more coil turns from it. In some cases, the circuit breaker trip bar is replaced or scrapped. These remedies all require a certain degree of disassembly and are costly in terms of labor and materials.

There is a need, therefore, for an improved trip mechanism which addresses manufacturing tolerances relating to the latch load required to release the circuit breaker operating mechanism.

There is a more particular need for an improved trip mechanism which provides a relatively consistent latch load.

There is another more particular need for an improved trip mechanism which reduces manufacturing costs.

SUMMARY OF THE INVENTION

These and other needs are satisfied by the invention which is directed to an electrical switching apparatus including housing means; separable contact means housed by the housing means and moveable between a closed position and an open position; operating means, for moving the separable contact means between the closed position and the open position thereof, having a first position and a second position corresponding to the open position of the separable contact means; means for latching the operating means in the first position thereof and for releasing the operating means to the second position thereof; trip bar means movable in a first direction and a second direction for unlatching the means for latching; means for sensing an electrical condition associated with the separable contact means and for moving the trip bar means in the second direction in order to unlatch the means for latching, release the operating means to the second position thereof, and move the separable contact means to the open position thereof; and adjustable bias means for biasing the trip bar means in the first direction.

As another aspect of the invention, a circuit interrupter apparatus includes housing means; separable contact means housed by the housing means and moveable between a closed position and an open position; operating means, for moving the separable contact means between the closed position and the open position thereof, having a first position and a second position corresponding to the open position of the separable contact means; latch means for latching the operating means in the first position thereof and for releasing the operating means to the second position thereof; trip bar means rotatable in a first rotational direction and a second rotational direction for unlatching the latch means; means for sensing an electrical condition associated with the separable contact means and for rotating the trip bar means in the second rotational direction in order to unlatch the latch means, release the operating means to the second position thereof, and move the separable contact means to the open position thereof; and adjustable bias means for biasing the trip bar means in the first rotational direction.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENT

Figure 1:
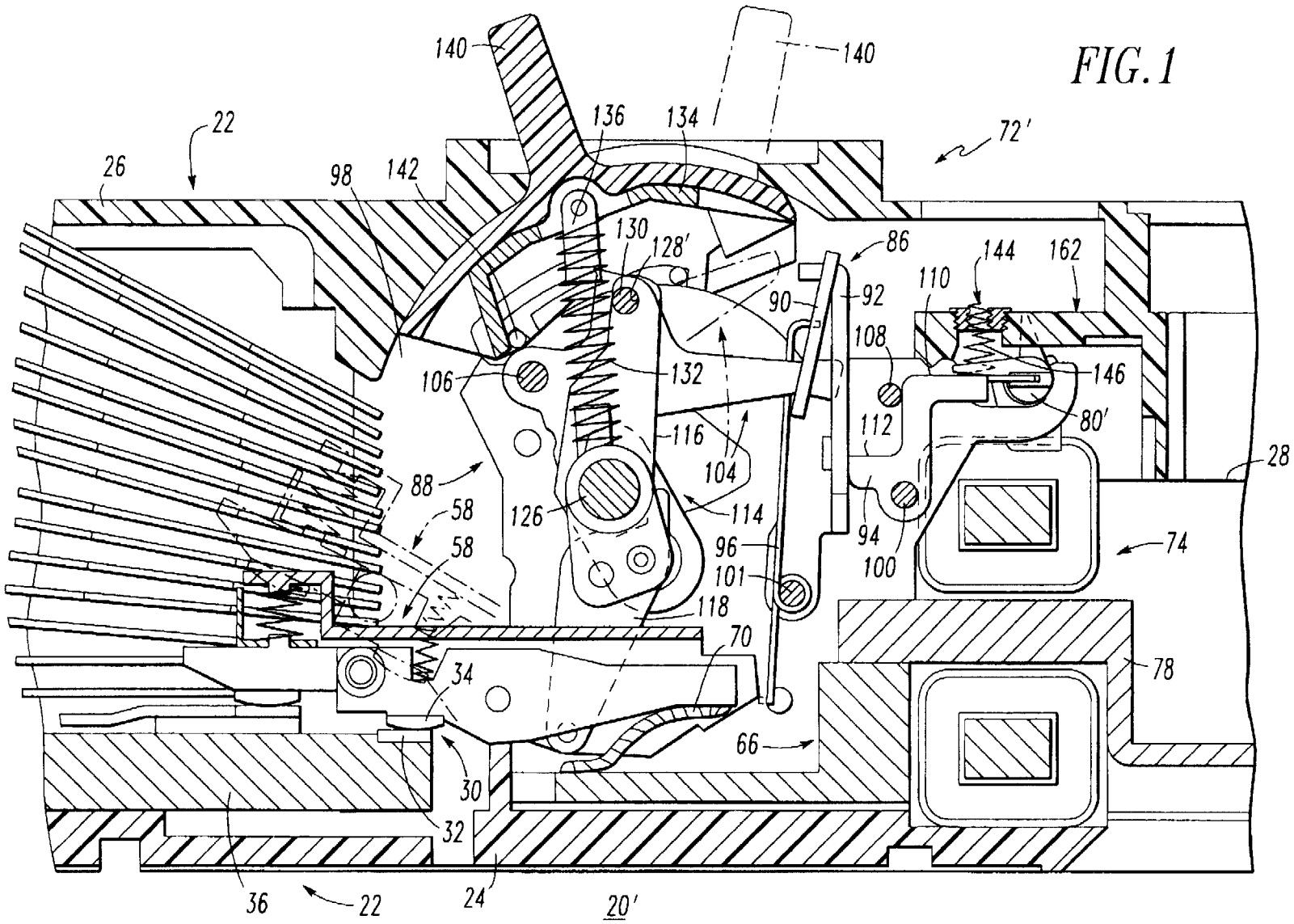
FIG. 1 is a vertical sectional view of a molded case circuit breaker in an on position incorporating an operating mechanism and a trip mechanism having a trip bar and an adjustable bias spring in accordance with the present invention.

A typical example of a circuit breaker is disclosed in U.S. Pat. No. 5,341,191 which is herein incorporated by reference. The reference numerals up to and including 140 employed herein are consistent with U.S. Pat. No. 5,341,191. Referring to FIG. 1, a molded case three phase circuit breaker 20' comprises an insulated housing 22, formed from a molded base 24 and a molded cover 26, assembled at a parting line 28, although the principles of the present invention are applicable to various types of electrical switching devices and circuit interrupters.

The circuit breaker 20' also includes at least one pair of separable main contacts 30 per phase, provided within the housing 22, which includes a fixed main contact 32 and a movably mounted main contact 34. The fixed contact 32 is carried by a line side conductor 36, electrically connected to a line side terminal (not shown) for connection to an external circuit (not shown). A movably mounted main contact arm assembly 58 carries the movable contact 34 and is electrically connected to a load conductor 66 by way of a plurality of flexible shunts 70. A free end (not shown) of a load conductor 78 connected to the load conductor 66 acts as a load terminal for connection to an external load, such as a motor.

Figure 8:
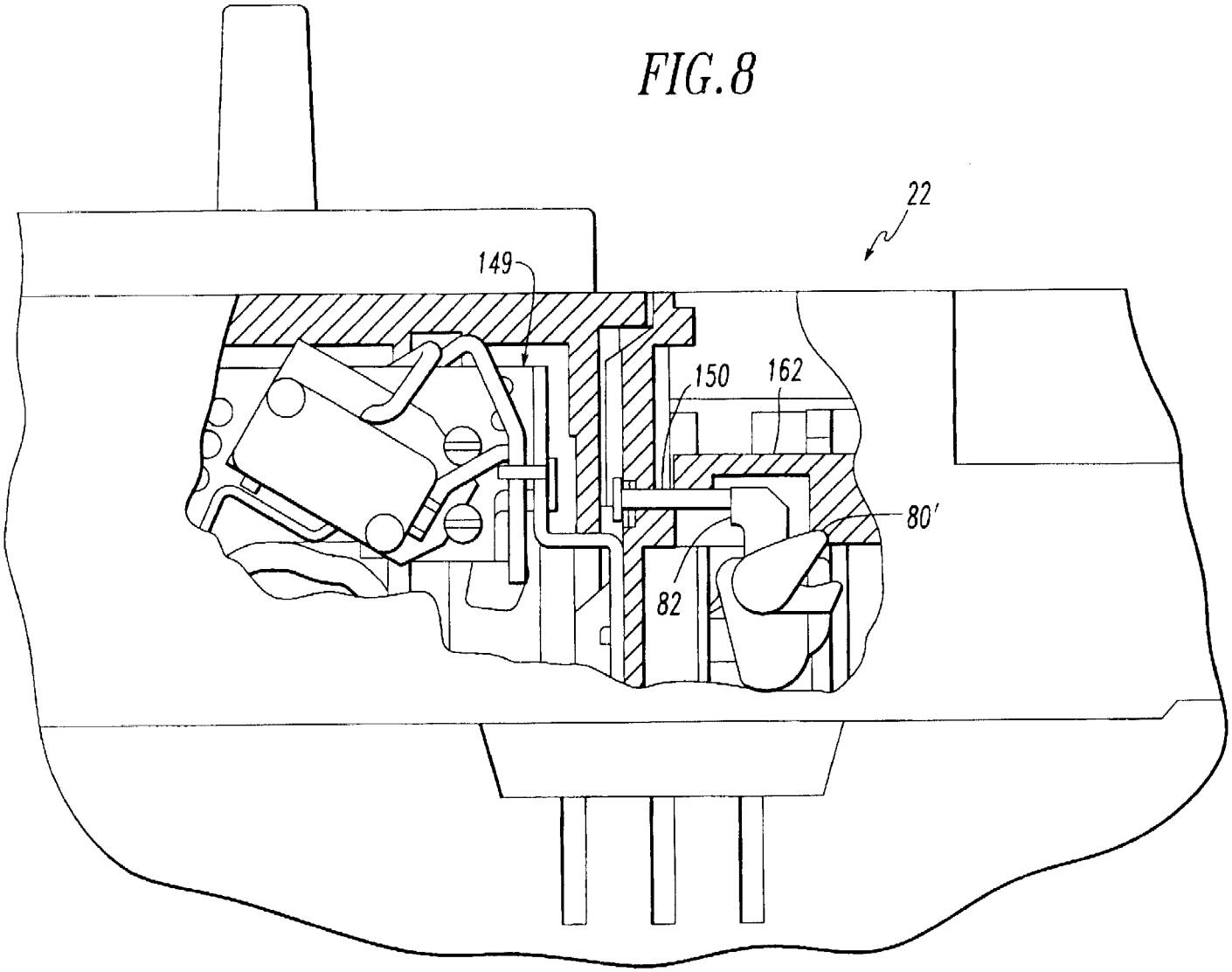
FIG. 8 is a cross-sectional view of an undervoltage trip assembly.

An electronic trip unit 72' includes, for each phase, a current transformer (CT) 74 for sensing load current. The CT 74 is disposed about the load conductor 78 and, in a manner well known in the art, detects current flowing through the separable contacts 30 in order to provide a signal to the trip unit 72' to trip the circuit breaker 20' under certain conditions, such as a predetermined overload condition. The trip unit 72' includes a trip bar 80' and a latch assembly 86. The trip bar 80' has an integrally formed extending trip lever 82 (shown in FIG. 2) mechanically coupled to an undervoltage trip assembly 149 (shown in FIG. 8) which cooperates to rotate the trip bar 80' clockwise (with respect to FIG. 1) during predetermined levels of overcurrent.

Figure 2:
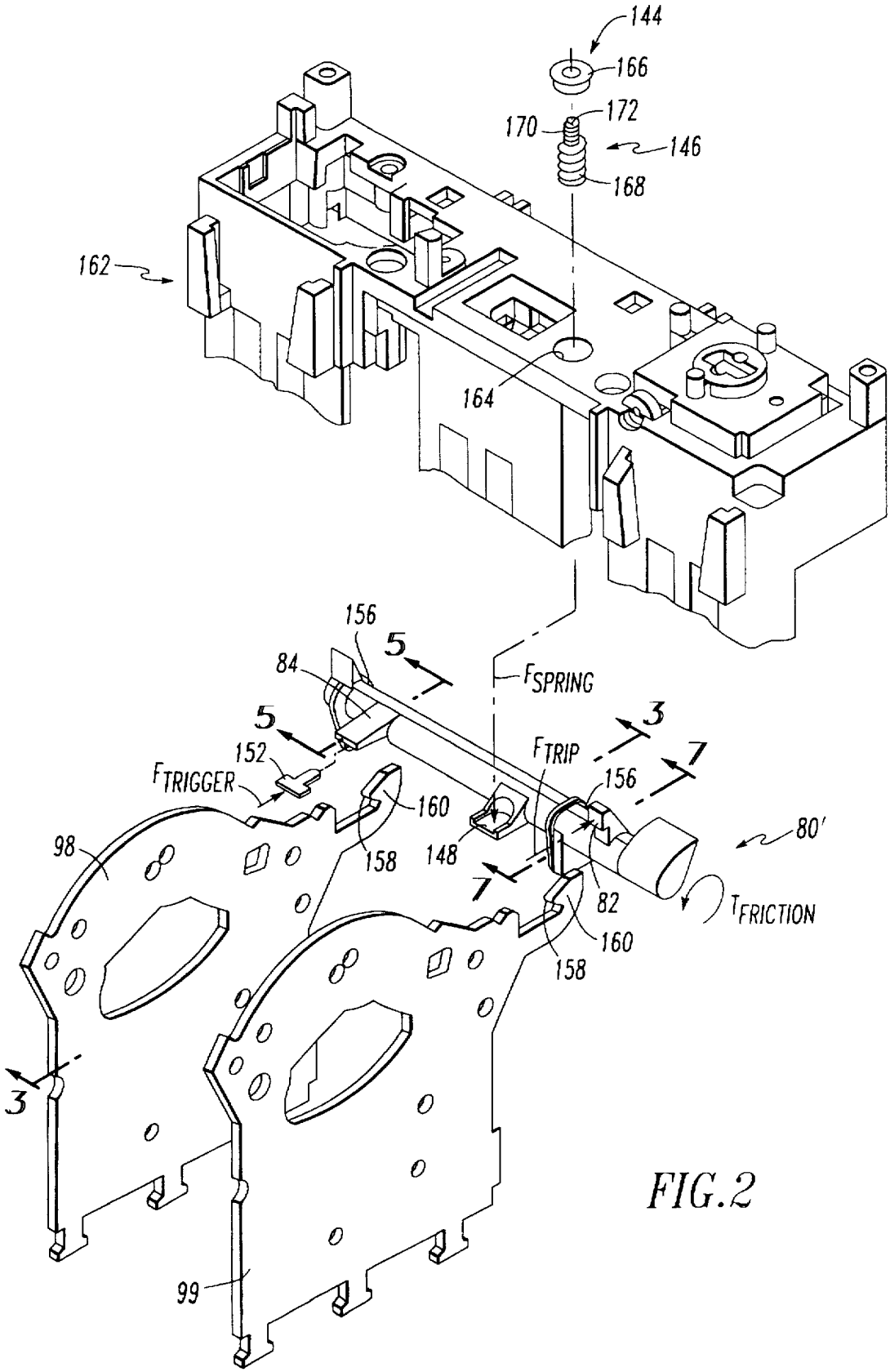
FIG. 2 is an exploded isometric view, with some parts not shown for clarity, of the trip bar and adjustable bias spring of FIG. 1.

The latch assembly 86 latches the operating mechanism 88 during conditions when the circuit breaker 20' is in an on position (shown in solid in FIG. 1) and a non-trip off position (partially shown in phantom line drawing with the arm assembly 58). During an overcurrent condition, the trip unit 72', and more specifically the trip bar 80', releases the latch assembly 86 to allow the circuit breaker 20' to trip. The latch assembly 86 includes a reset plate 90, a pivotally mounted lock plate 92, a latch lever trigger assembly 94, and a biasing spring 96. The lock plate 92 is pivotally mounted to a pair of spaced apart side plates 98 and 99 (both are shown in FIG. 2), used to carry the operating mechanism 88, by way of a pin 101. The reset plate 90 is coupled to the lock plate 92 at one end. The other end of the lock plate 92 is mounted for arcuate movement within the side plates 98,99. The lock plate 92 includes a pair of spaced apart notches (not shown) for latching a cradle mechanism 104 which forms a portion of the operating mechanism 88. The biasing spring 96 biases the reset plate 90 and the lock plate 92 counterclockwise (with respect to FIG. 1).

The operating mechanism 88 has a latched position (shown in solid in FIG. 1) provided by the latch assembly 86. Upon clockwise rotation of the trip bar 80', an insert 152 (shown in FIGS. 2 and 5) beneath a latch lever 84 (shown in FIGS. 2 and 5), integrally formed on the trip bar 80', releases the trigger assembly 94. In turn, the trigger assembly 94 releases the latch assembly lock plate 92 which, in turn, releases the operating mechanism 88 to the unlatched position thereof (partially shown in phantom line drawing in FIG. 1 with the cradle mechanism 104) in order to move the separable contacts 30 to the trip open position thereof, thereby allowing the circuit breaker 20' to trip.

The trigger assembly 94 is pivotally mounted to the two side plates 98,99 by the pin 100 and is biased in a counterclockwise direction (with respect to FIG. 1) by a torsion spring (not shown). A stop pin 108 serves to limit rotation of the trigger assembly 94. The trigger assembly 94 is integrally formed with an upper latch portion 110 and a lower latch portion 112. The lower latch portion 112 is adapted to engage the lock plate 92. The upper latch portion 110 is adapted to communicate with the insert 152 (shown in FIGS. 2 and 5) of the trip bar 80'.

The operating mechanism 88 moves the separable main contacts 30 between the closed and open positions thereof and, thus, facilitates opening and closing the separable contacts 30. The operating mechanism 88 includes a toggle assembly 114 which has a pair (only one is shown in FIG. 1) of upper toggle links 116 and a pair (only one is shown in FIG. 1) of lower or trip links 118. Each of the upper toggle links 116 receives a crossbar 126 and is provided with a hole 128' which allows it to be mechanically coupled to the cradle mechanism 104 by way of a pin 130. Operating springs 132 are connected between the crossbar 126 and a handle yoke assembly 134 by way of spring retainers 136.

The cradle mechanism 104 is pivotally connected to the side plates 98,99 by way of a pin 106. The cradle mechanism 104, in cooperation with the latch assembly 86, allows the circuit breaker 20' to be tripped by way of the trigger assembly 94 of the trip unit 72'. In order to reset the cradle mechanism 104, it is necessary to rotate the operating handle 140 toward the off position (shown in phantom line drawing in FIG. 1). The operating handle 140, in cooperation with the handle yoke 134 and a reset pin 142 driven by the yoke 134, allows the cradle mechanism 104 to be moved clockwise (with respect to FIG. 1) and latched relative to the latch assembly 86.

The housing 22, separable contacts 30, operating mechanism 88, operating handle 140 and handle yoke 134, and trip unit 72' excluding the trip bar 80' are disclosed in greater detail in U.S. Pat. No. 5,341,191. The present invention provides improvements disclosed herein in connection with the trip bar 80' and an adjustable bias mechanism 144 which biases the trip bar 80' in the counterclockwise direction (with respect to FIG. 1).

The trip bar 80' is rotatable in the counterclockwise direction under the bias of the mechanism 144 and in the clockwise direction as discussed above. The trip unit 72' senses an electrical condition, such as an overcurrent condition, associated with the separable contacts 30 and rotates the trip bar 80' in the clockwise rotational direction in order to unlatch the latch assembly 86, release the operating mechanism 88 to the unlatched position thereof, and move the separable contacts 30 to the open position thereof, although the invention is applicable to a wide range of such sensed electrical conditions (e.g., an undervoltage condition, a trip condition detected by an external shunt trip device which remotely trips the circuit breaker 20').

Figure 3:
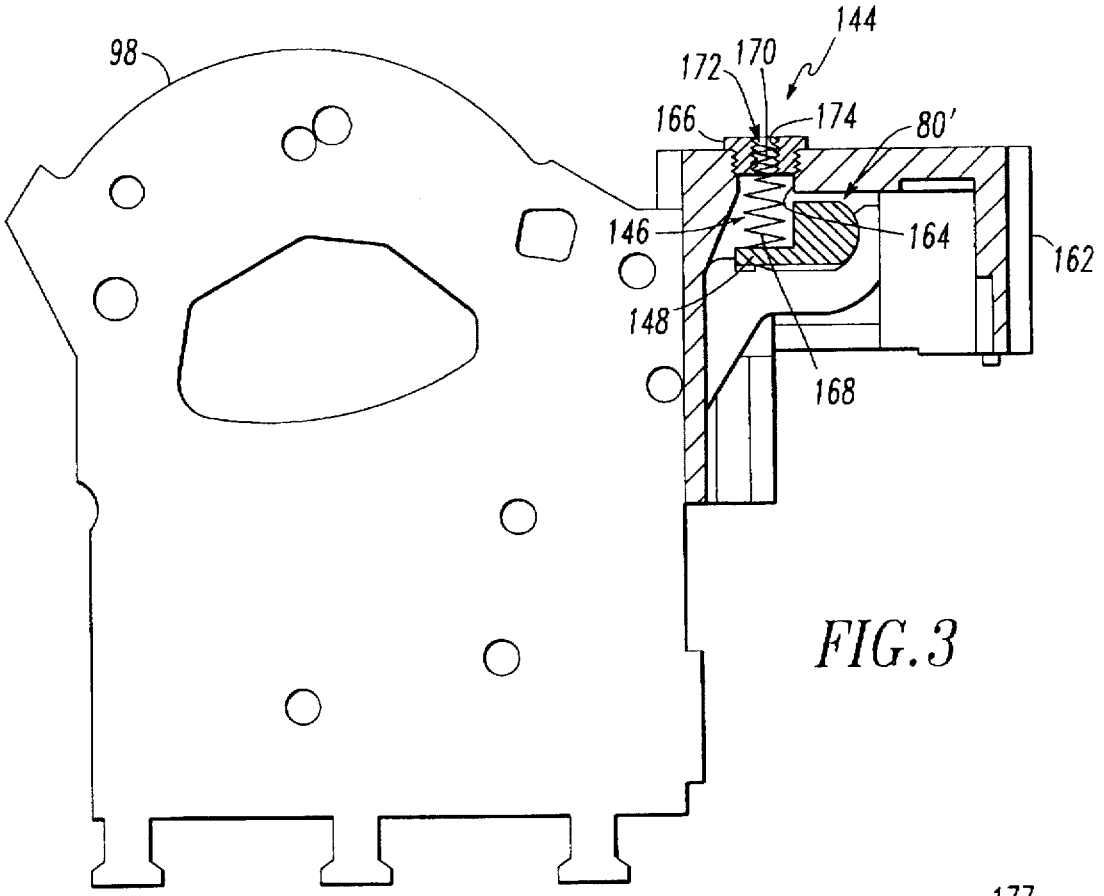
FIG. 3 is a cross-sectional view of the trip mechanism, trip bar and adjustable bias spring of FIG. 1, with some parts not shown for clarity, along lines 3—3 of FIG. 2.

FIGS. 2 and 3 illustrate the exemplary plastic molded trip bar 80' of the trip unit 72' of FIG. 1 and the adjustable bias spring mechanism 144 having an adjustable helical compression bias spring 146. The elongated trip bar 80' has a transverse member or paddle 148. The paddle 148 is the point of actuation of the bias spring 146 upon the trip bar 80' which is biased by the spring 146 in the counterclockwise direction (with respect to FIGS. 2 and 3). The elongated spring 146 is generally normal to the trip bar 80'. The trip bar 80' also has the insert 152 (shown in FIG. 2), which is engaged by the latch assembly 86 of FIG. 1, and the trip lever 82, which is engaged by a plunger, such as a trip pin plunger 150 of FIG. 8, to rotate the trip bar 80' in the clockwise direction (with respect to FIGS. 2 and 3) in order to unlatch the latch assembly 86. The exemplary steel latch insert 152 is assembled into a diametrical hole 154 (shown in FIGS. 5 and 6) in the trip bar 80'. Two recesses 156 (best shown in FIG. 7) retain the trip bar 80' axially in the side plates 98,99 which provide pivot points 158 for rotation of the trip bar 80' on side plate ears 160.

An internal deck or molded housing member 162 of the housing 22 of FIG. 1 has an opening 164. A threaded insert 166 is rigidly pressed into the opening 164 or is suitably molded into place in the deck 162. A portion of the bias spring 146 engages the internal thread 174 (shown in FIG. 3) of the insert 166 at about the opening 164 of the deck 162.

Figure 4:
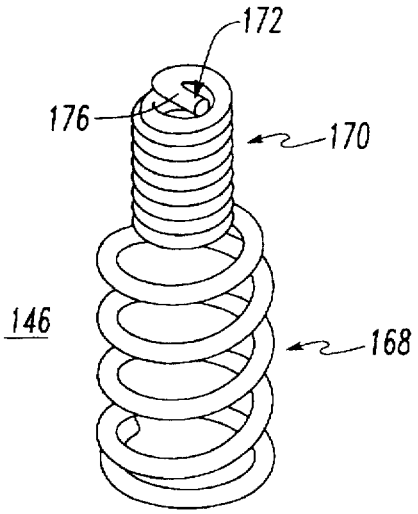
FIG. 4 is an isometric view of the adjustable bias spring of FIG. 1.

As best shown in FIG. 4, the exemplary bias spring 146 has a major diameter 168 and a minor diameter 170 with a spring end 172 turned in toward the center of the body of the minor diameter 170. Preferably, the wire size and minor diameter 170 of the bias spring 146 are selected to allow such diameter 170 to wind snugly into the internal thread 174 of the insert 166 of FIG. 3, with the pitch of the diameter 170 being slightly shorter than the pitch of the internal thread 174. The trip bar 80' is assembled into the two side plates 98,99 supported by the side plate ears 160. The deck 162, the bias spring 146 and the insert 166 are assembled over the trip bar 80' and side plates 98,99 in order that the end of the major diameter 168 of the bias spring 146 engages the paddle 148 of the trip bar 80'.

Still referring to FIGS. 2 and 3, the minor diameter upper portion 170 of the spring 146 is biased with respect to and engages the insert 166 of the deck 162 at about the opening 164 thereof. The lower portion 168 of the spring 146 engages and biases the paddle 148 of the trip bar 80'. The upper spring end 172 forms a cross member 176 adjacent the opening 164 of the deck 162. The cross member 176 is rotatable by a suitable adjustment member (not shown) through the opening 164 in order to adjust the length of the bias spring 146 and, hence, the bias on the paddle 148 of the trip bar 80'.

Figure 5:
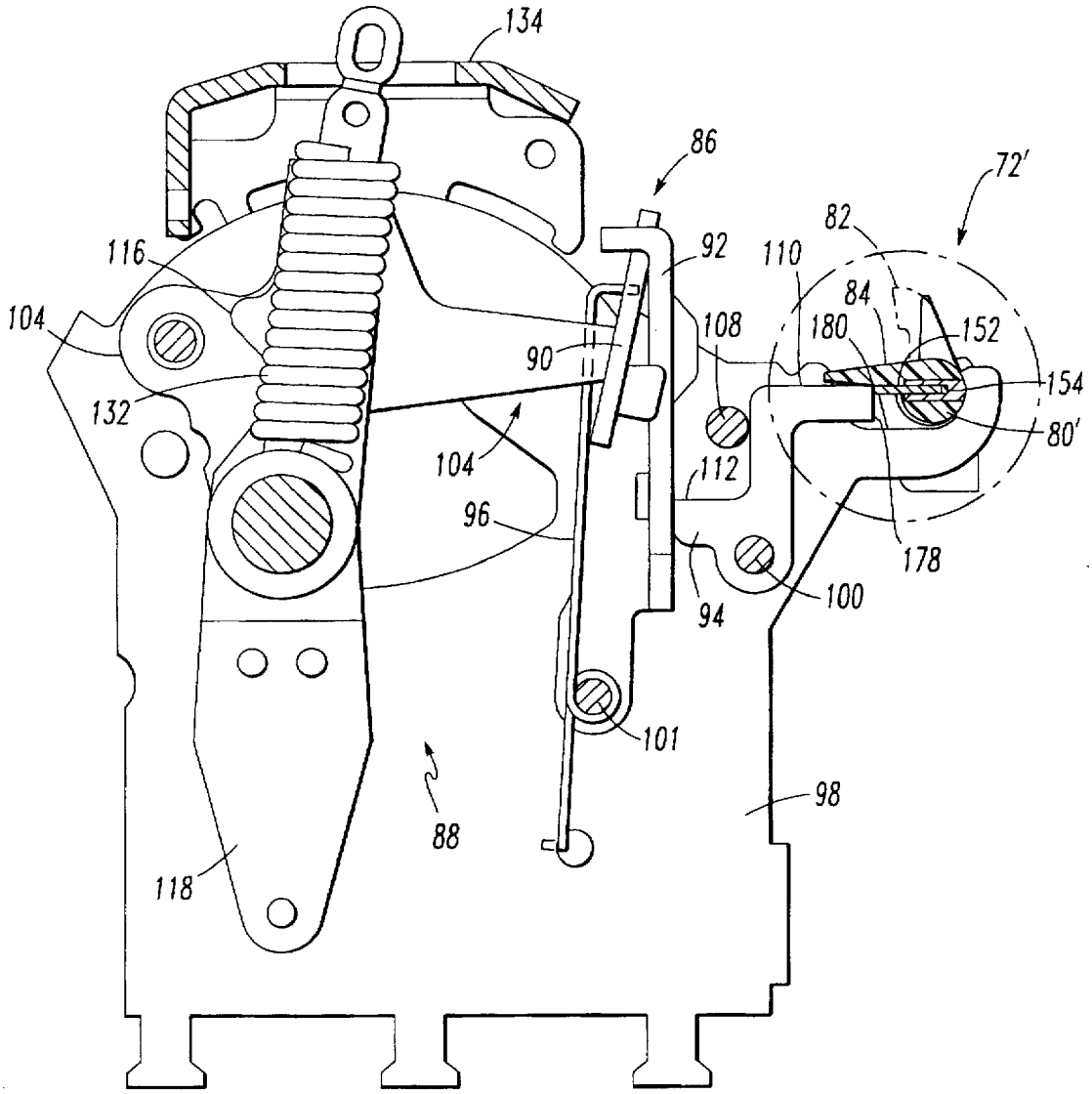
FIG. 5 is a cross-sectional view of the operating mechanism and the trip mechanism of FIG. 1, with some parts not shown for clarity, along lines 5—5 of FIG. 2.
Figure 6:
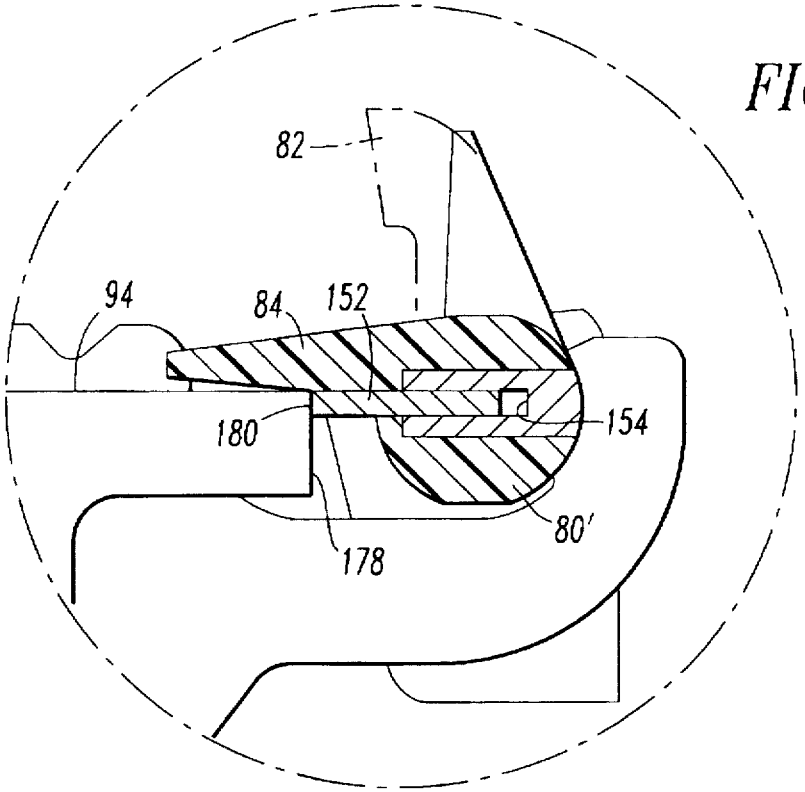
FIG. 6 is a more detailed view of the trip bar of FIG. 5.
Figure 7:
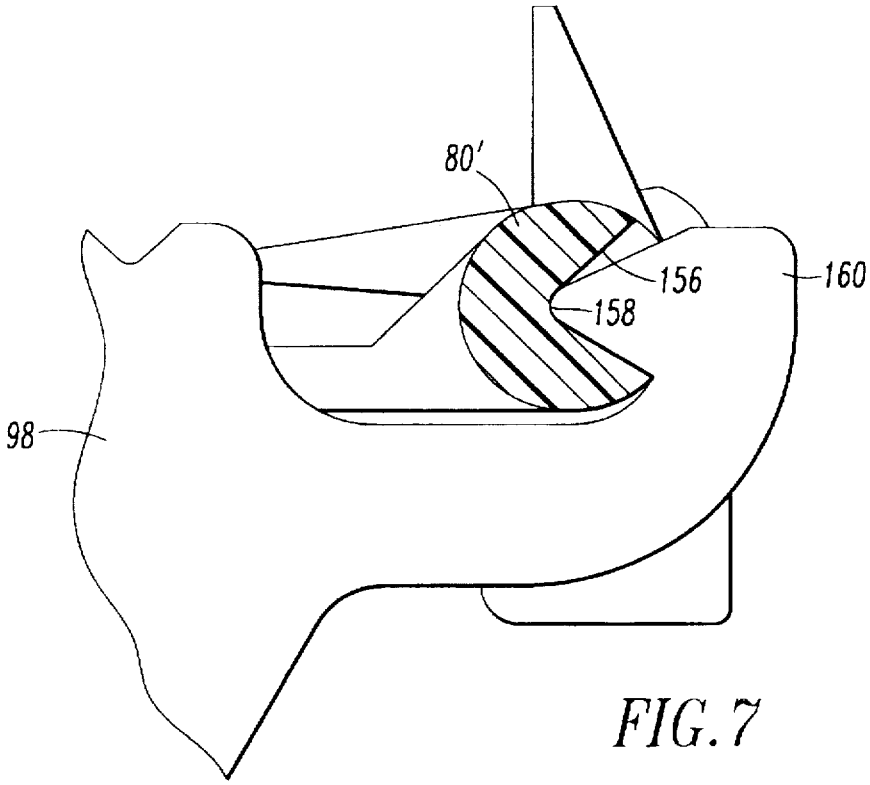
FIG. 7 is a cross-sectional view along lines 7—7 of FIG. 2.

Referring to FIGS. 5 and 6, the interface between the operating mechanism 88 (shown with the circuit breaker handle 140 of FIG. 1 in the off position) and the trip unit 72' is illustrated. The interface between the trip bar 80' and the trigger assembly 94 is between the edge 178 of the assembly 94 and the surface 180 of latch insert 152.

Referring again to FIG. 2, the forces involved in determining latch load are illustrated. The latch load is typically measured as the force, $F_{TRIP}$, required by a test probe (not shown) at trip lever 82 (i.e., the actuation point of accessory attachments to the circuit breaker 20' of FIG. 1) on the trip bar 80' to cause the clockwise torque about the axial centerline of the trip bar 80' necessary to release the trigger assembly 94. There are three other torques present on the trip bar 80' during a tripping action.

First, there is a counterclockwise torque, $T_{FRICTION}$, resisting clockwise rotation of the trip bar 80' due to friction between the trip bar 80' and the side plates 98,99 at the pivot points 158. Preferably, a tetrafluoroethylene (which is sold under the trade designation, "Teflon") based grease or another suitable lubricant is employed in the recesses 156 of the trip bar 80' to minimize friction at the pivot points 158.

The second torque is due to the load, $F_{TRIGGER}$, imposed by the trigger assembly 94 on the latch insert 152 at the surface 180 (shown in FIG. 6) thereof. This is a clockwise torque, tending to push the trip bar 80' "off latch". Preferably, this clockwise torque is minimized to reduce shock-outs. The force $F_{TRIGGER}$ is dependent upon many variables within the operating mechanism 88 of FIG. 1 (e.g., toggle spring force, parts tolerance) which are normal manufacturing variables.

The third torque imposed on the trip bar 80' is counterclockwise due to the force, $F_{SPRING}$, of the bias spring 146 acting on the paddle 148. It will be appreciated by those skilled in the art that, of these three torques, the most controllable is that due to the adjustable bias spring 146 of the invention. This is typically done by adjusting the length of the bias spring 146.

The cross member 176 (shown in FIG. 4) of the turned-in spring end 172 allows a suitable adjusting tool (not shown) to grab the bias spring 146 and rotate it within the threaded insert 166. Since the spring pitch is slightly undersized relative to the pitch of the threaded insert 166, rotation of the bias spring 146 causes it to wind itself into and/or out of the insert 166 and to extend the length of such spring 146 slightly at the minor diameter end 170. This extension in the minor diameter 170 induces friction between the wire of the spring 146 and the internal thread 174 of the insert 166 to prevent the adjustment from changing during normal operation of the circuit breaker 20'. Increasing (decreasing) the free length of the bias spring 146 between the assembly formed by the deck 162, the threaded insert 166 and the trip bar paddle 148 causes the load between such spring 146 and the trip bar paddle 148, $F_{SPRING}$, to increase (decrease) proportionally. The force $F_{SPRING}$ directly effects torque on the trip bar 80'. An assembly operator is then able to adjust the spring load and measure (e.g., using a load cell) latch load resulting from that change.

Figure 9:
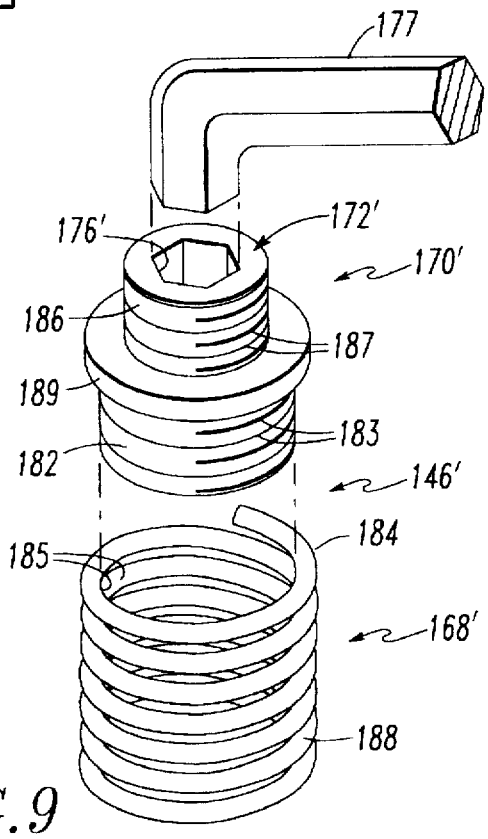
FIG. 9 is an exploded isometric view of another adjustable bias spring in accordance with an alternative embodiment of the present invention.

FIG. 9 illustrates another adjustable helical compression bias spring 146' in accordance with an alternative embodiment of the invention. The spring 146' includes a lower major diameter member 168' and a separate upper minor diameter member or spacer member 170'. The lower portion 182 of the upper member 170' has a thread 183 which threads inside the upper portion 184 of the lower member 168' at about thread 185 thereof. The upper portion 186 of the upper member 170' has a thread 187 which threads into the thread 174 at about the opening 164 of the deck 162 of FIG. 3. The lower portion 182 of the upper member 170' has a shoulder 189 engaging the upper portion 184 of the lower member 168'. The lower portion 188 of the lower member 168' biases the paddle 148 of the trip bar 80' of FIG. 2.

The spacer member 170' has an opening 176' in the upper portion 186. The opening 176', such as a hex hole, is suitable for engagement by an adjustment device, such as hex wrench 177, adjacent the opening 164 of the deck 162 of FIG. 3. The spacer member 170' is rotatable by the hex wrench 177 in order to adjust the length of the bias spring 146' and the bias on the paddle 148 of the trip bar 80' of FIG. 2. Although the exemplary spacer member 170' has a hex hole, any suitable interface for a corresponding adjustment tool may be provided (e.g., a slot for a conventional screwdriver, a double slot for a Phillips screwdriver).

Figure 10:
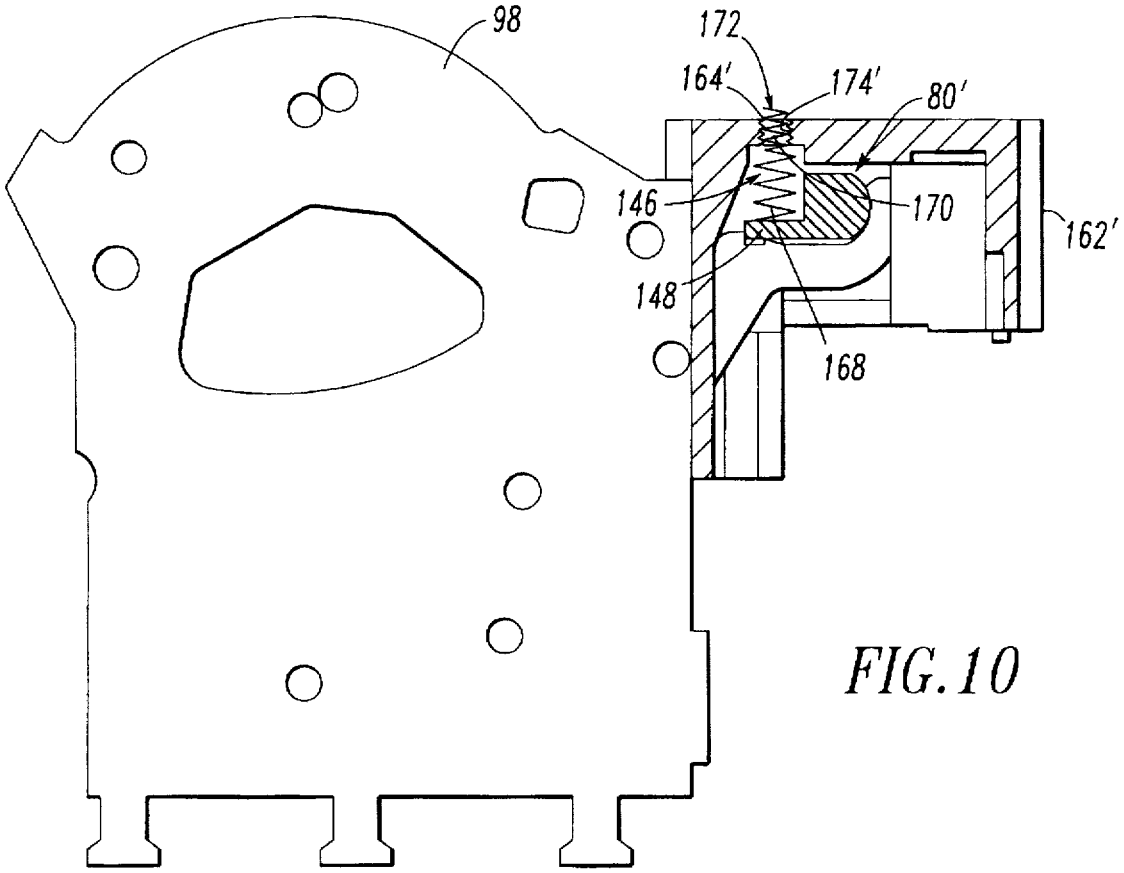
FIG. 10 is a cross-sectional view, with some parts not shown for clarity, of the adjustable bias spring of FIG. 4 and a deck in accordance with an alternative embodiment of the present invention.

Referring to FIG. 10, an alternative deck 162' is illustrated. The deck 162' is a molded deck having an opening 164' and a molded thread 174' at about the opening 164'. In this manner, the threaded insert 166 of FIG. 2 may be eliminated. The upper portion 170 of the bias spring 146 engages the thread 174' of the molded deck 162'. It will be appreciated that the thread 174' may equivalently be provided by cutting such thread 174' at about the opening 164' and/or the bias spring 146' of FIG. 9 may be employed.

Figure 11:
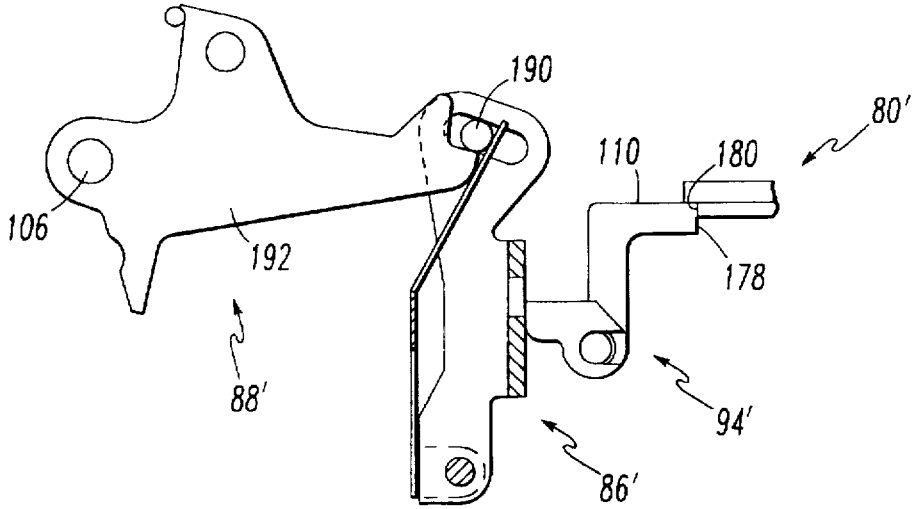
FIG. 11 is a cross-sectional view of an alternative latching and releasing mechanism and an alternative trigger mechanism engaged by the trip bar of FIG. 1.

Although an exemplary operating mechanism 88, latch assembly 86 and trigger assembly 94 have been disclosed herein, it will be appreciated that the trip unit 72', trip bar 80' and adjustable bias springs 146,146' may be employed with a wide variety of other mechanisms and assemblies such as, for example, operating mechanism 88', latch assembly 86' and trigger assembly 94' which utilize a roller pin 190 to latch and release one or more cradles 192 as shown in FIG. 11.

The present invention provides an improved trip unit 72' for latching and releasing an operating mechanism of an electrical switching apparatus. The trip bar 80' and adjustable bias springs 146,146' disclosed herein provide for the adjustment of the latch load within tighter tolerances than presently achieved without requiring disassembly of the trip unit 72'. Preferably, the adjustment provided by one of the disclosed bias springs 146,146' is made during manufacture of the circuit breaker 20' with the circuit breaker housing 22 disassembled to expose the opening 164.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An electrical switching apparatus comprising:

housing means;

separable contact means housed by said housing means and moveable between a closed position and an open position;

operating means for moving said separable contact means between the closed position and the open position thereof, said operating means having a first position and a second position corresponding to the open position of said separable contact means;

means for latching said operating means in the first position thereof and for releasing said operating means to the second position thereof;

trip bar means movable in a first direction and a second direction for unlatching said means for latching;

means for sensing an electrical condition associated with said separable contact means and for moving said trip bar means in the second direction in order to unlatch said means for latching, release said operating means to the second position thereof, and move said separable contact means to the open position thereof; and adjustable bias means for biasing said trip bar means in the first direction.

2. The apparatus as recited in claim 1 wherein said adjustable bias means includes bias spring means; and wherein said trip bar means includes a trip bar having a member biased by said bias spring means.

3. The apparatus as recited in claim 2 wherein said bias spring means has a first end biased with respect to said housing means and a second end which biases the member of said trip bar; wherein said housing means has an opening therein; and wherein said bias spring means, at about the first end thereof, engages said housing means at about the opening thereof.

4. The apparatus as recited in claim 3 wherein said housing means further includes thread means at about the opening thereof; wherein said bias spring means has a first spring portion which engages the thread means of said housing means; and wherein said bias spring means has a second spring portion which engages the member of said trip bar.

5. The apparatus as recited in claim 4 wherein the thread means of said housing means has a first pitch; and wherein the first spring portion of said bias spring means has a second pitch, which is smaller than said first pitch, engaging the thread means of said housing means.

6. The apparatus as recited in claim 4 wherein the first spring portion of said bias spring means has a cross member adjacent the opening of said housing means, said cross member being rotatable in order to adjust the bias on the member of said trip bar.

7. The apparatus as recited in claim 3 wherein said housing means further includes insert means in said opening having a thread; and wherein said bias spring means has a portion which engages the thread of said insert means.

8. The apparatus as recited in claim 3 wherein said housing means further includes a molded housing member having a thread at about said opening; and wherein said bias spring means has a portion which engages the thread of said molded housing member.

9. The apparatus as recited in claim 2 wherein said housing means has an opening therein; and wherein said bias spring means includes a bias spring having a first portion and a second portion which biases the member of said trip bar, and also includes a spacer member having a first portion and a second portion, with the first portion of said spacer member engaging said housing means at about the opening thereof, and with the second portion of said spacer member engaging the first portion of said bias spring.

10. The apparatus as recited in claim 9 wherein said housing means further includes thread means at about the opening thereof; wherein the first portion of said spacer member has a first thread engaging the thread means of said housing means; and wherein the second portion of said spacer member has a shoulder engaging the first portion of said bias spring.

11. The apparatus as recited in claim 10 wherein the first portion of said spacer member has means for engaging an adjustment device adjacent the opening of said housing means, said spacer member being rotatable by said adjustment device in order to adjust the bias on the member of said trip bar.

12. The apparatus as recited in claim 2 wherein said trip bar means includes an elongated trip bar having a transverse member biased by said bias spring means; and wherein said bias spring means includes an elongated bias spring which is generally normal to the elongated trip bar.

13. The apparatus as recited in claim 1 wherein said trip bar means is rotatable in a first rotational direction and a second rotational direction for unlatching said means for latching; and wherein said means for sensing rotates said trip bar means in the second rotational direction in order to unlatch said means for latching; and wherein said adjustable bias means biases said trip bar means in the first rotational direction.

14. A circuit interrupter apparatus comprising:

housing means;

separable contact means housed by said housing means and moveable between a closed position and an open position;

operating means for moving said separable contact means between the closed position and the open position thereof, said operating means having a first position and a second position corresponding to the open position of said separable contact means;

latch means for latching said operating means in the first position thereof and for releasing said operating means to the second position thereof;

trip bar means rotatable in a first rotational direction and a second rotational direction for unlatching said latch means;

means for sensing an electrical condition associated with said separable contact means and for rotating said trip bar means in the second rotational direction in order to unlatch said latch means, release said operating means to the second position thereof, and move said separable contact means to the open position thereof; and adjustable bias means for biasing said trip bar means in the first rotational direction.

15. The apparatus as recited in claim 14 wherein said housing means has an opening therein; wherein said trip bar means includes a trip bar having a member biased by said adjustable bias means; and wherein said adjustable bias means includes bias spring means having a first end and a second end which engages the member of said trip bar, with said adjustable bias means, at about the first end thereof, engaging said housing means at about the opening thereof.

16. The apparatus as recited in claim 15 wherein said bias spring means further has a cross member adjacent the opening of said housing means, said cross member being rotatable in order to adjust the bias on the member of said trip bar.

17. The apparatus as recited in claim 15 wherein said housing means further includes insert means having thread means at about said opening; and wherein said bias spring means has a portion which engages the thread means of said insert means.

18. The apparatus as recited in claim 15 wherein said housing means further includes a molded housing member having a molded thread at about said opening; and wherein said bias spring means has a portion which engages the molded thread of said molded housing member.

19. The apparatus as recited in claim 15 wherein the member of said trip bar is a first member; wherein said trip bar further has a second member which is engaged by said latch means and a third member which is engaged by said means for rotating said trip bar means.

20. The apparatus as recited in claim 15 wherein said bias means spring means includes a bias spring engaged by a spacer having means for engagement by an adjustment device adjacent the opening of said housing means, said spacer being rotatable by said adjustment device in order to adjust the bias on the member of said trip bar.

* * * * *